US006410853B1

(12) United States Patent
Peters et al.

(10) Patent No.: US 6,410,853 B1
(45) Date of Patent: Jun. 25, 2002

(54) ELECTRICAL CONNECTION AND METHOD OF ATTACHING AN ELECTRIC CONDUCTOR TO AN ELECTRICALLY CONDUCTIVE TERMINAL VIA A TELESCOPING SLEEVE

(75) Inventors: Chuck Peters, Bowling Green; William Riggs, Russellville, both of KY (US); John H. Hussey, St. Louis; Vincent P. Fargo, St. Charles, both of MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/754,561

(22) Filed: Jan. 4, 2001

(51) Int. Cl.[7] ..... H01R 4/00
(52) U.S. Cl. ..... 174/84 R; 174/88 C
(58) Field of Search ..... 174/74 R, 84 R, 174/75 C, 88 C, 86, 93, 88 R; 439/607, 608, 610, 585

(56) References Cited

U.S. PATENT DOCUMENTS 3,112,150 A * 11/1963 Hammell ..... 339/276
3,953,103 A * 4/1976 Mathis ..... 339/276 T
4,815,200 A * 3/1989 Ito ..... 29/857
4,840,578 A * 6/1989 Sato ..... 439/395
5,025,554 A * 6/1991 Dohi ..... 29/860
5,408,048 A * 4/1995 Endo et al. ..... 174/74 R
5,429,529 A * 7/1995 Hashizawa et al. ..... 439/610
5,736,678 A * 4/1998 Kobayashi ..... 174/84 C
5,908,326 A * 6/1999 Neuhauser et al. ..... 439/399
5,965,847 A * 10/1999 Tanaka et al. ..... 174/84 R
6,107,572 A * 8/2000 Miyazaki ..... 174/75 C

* cited by examiner

*Primary Examiner*—Dean A. Reichard
*Assistant Examiner*—William H. Mayo, III
(74) *Attorney, Agent, or Firm*—Thompson Coburn LLP

(57) ABSTRACT

A method for attaching an electric conductor to an electrically conductive terminal. The electric conductor has a wire and a cladding surrounding the wire. The wire has an exposed end portion extending from an end of the cladding. The method includes placing a sleeve over the electric conductor. The sleeve is an electrically insulative material. The method further includes positioning the exposed end portion of the wire adjacent the terminal, securing the exposed end portion of the wire to a first portion of the terminal in a manner so that the exposed end portion of the wire is mechanically secured to and electrically coupled to the terminal, moving the sleeve along the electric conductor to a position in which a portion of the sleeve is adjacent the terminal, and securing the sleeve to a second portion of the terminal in a manner so that the sleeve is mechanically secured to the terminal.

6 Claims, 2 Drawing Sheets

ELECTRICAL CONNECTION AND METHOD OF ATTACHING AN ELECTRIC CONDUCTOR TO AN ELECTRICALLY CONDUCTIVE TERMINAL VIA A TELESCOPING SLEEVE

BACKGROUND OF THE INVENTION

This invention relates to electrical connections and methods of attaching an electric conductor to an electrically conductive terminal.

Electric motors and other electro-magnetic devices typically have direct connect terminals in which the terminal is secured to an electric conductor for a magnet. To attach the conductor to the terminal, some of the conductor's cladding must first be trimmed to expose an end portion of the conductor's wire. The exposed end of the wire is then inserted into the terminal. The terminal is then crimped in two locations. One of the crimps secures the exposed end of the wire to the terminal so that the wire is electrically coupled to the terminal. The other crimp secures the conductor's cladding to the terminal.

The conductor is generally required to be a precise length. Often, too much of the cladding is trimmed during the attaching process. If too much cladding is trimmed, then the cladding is not sufficiently long to reach the terminal. In some cases the cladding can be pulled out a sufficient length from the stator slot to enable the cladding to reach the terminal. In other cases, adjustment of the cladding cannot be accomplished at all.

Because of the difficulties caused by too much of the cladding being trimmed, the prior art has focused on prevention. Presently, the trimming operation is performed via a hand-held device which singes or melts the cladding a fixed distance from the end of the wire. Removing a fixed length of the cladding prevents a situation in which too much of the cladding is trimmed. However, hand-held devices having two-edge singe blades are generally awkward to use and must be rotated 360 degrees around the conductor to produce complete separation. Melting of the cladding sometimes produces an uneven cut, making it difficult to locate and to securely crimp the cladding into the insulation crimp of the terminal. The melting process also produces noxious gasses that require ventilation.

SUMMARY OF THE INVENTION

Among the several advantages of the present invention is the provision of an improved method of attaching an electric conductor to an electrically conductive terminal; the provision of such a method in which the electric conductor's cladding need not be trimmed to a particular length; the provision of such a method in which the cladding need not be trimmed in a particular manner and in which the end of the cladding need not be evenly cut; and the provision of an electrical connection which overcomes the disadvantages of prior art connections.

In general, a method of the present invention is for attaching an electric conductor to an electrically conductive terminal. The electric conductor comprises a wire and a cladding surrounding the wire. The cladding is of an electrically insulative material. The wire has an exposed end portion extending from an end of the cladding. The method comprises placing a sleeve over the electric conductor. The sleeve is of an electrically insulative material. The method further includes positioning the exposed end portion of the wire adjacent the terminal, securing the exposed end portion of the wire to a first portion of the terminal in a manner so that the exposed end portion of the wire is mechanically secured to and electrically coupled to the terminal, moving the sleeve along the electric conductor to a position in which a portion of the sleeve is adjacent the terminal, and securing the sleeve to a second portion of the terminal in a manner so that the sleeve is mechanically secured to the terminal.

Another aspect of the present invention is an electrical connection comprising an electric conductor, an electrically conductive terminal and a sleeve. The electric conductor has a wire and a cladding surrounding the wire, the cladding is of an electrically insulative material. The wire has an exposed end portion extending from an end of the cladding. The terminal has a first portion and a second portion. The sleeve surrounds the electric conductor and is of an electrically insulative material. The exposed end portion of the wire is secured to the first portion of the terminal in a manner so that the exposed end portion of the wire is mechanically secured to and electrically coupled to the terminal and so that the second portion of the terminal is generally between the end of the cladding and the first portion of the terminal. The sleeve is secured to the second portion of the terminal in a manner so that the sleeve is mechanically secured to the terminal. The sleeve covers the end of the cladding and a protected portion of the wire. The protected portion of the wire extends from the first portion of the terminal to the end of the cladding.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 4:
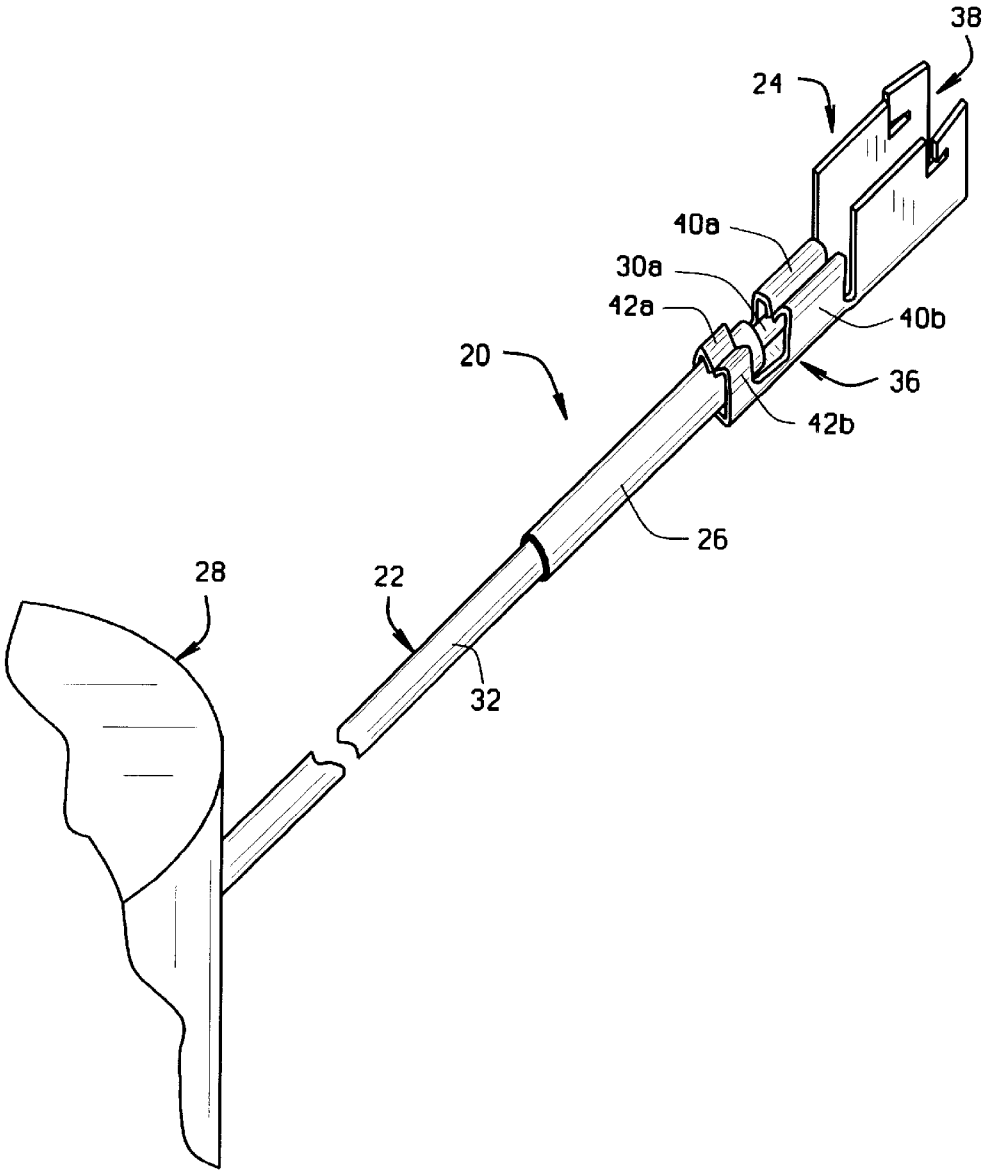
FIG. 4 is a perspective view similar to FIG. 3 but with insulation holding tabs of the terminal bent to hold the sleeve.

Referring now to the drawings, an electrical connection of the present invention is indicated in its entirety by the reference numeral 20. The electrical connection 20 comprises a electric conductor, generally indicated at 22, an electrically conductive terminal, generally indicated at 24, and a sleeve, generally indicated at 26. Preferably, the electric conductor 22 is a conductor of an electromotive device, and more preferably is a conductor of an electric motor, generally indicated at 28 (FIG. 4). The electric conductor 22 includes a wire 30 and cladding 32 surrounding the wire. The wire 30 is of an electrically conductive material, such as copper, and has an exposed end portion 30*a* extending from an end 32*a* of the cladding. The cladding 32 is of an electrically insulative material, such as Mylar® or any other suitable material.

Figure 1:
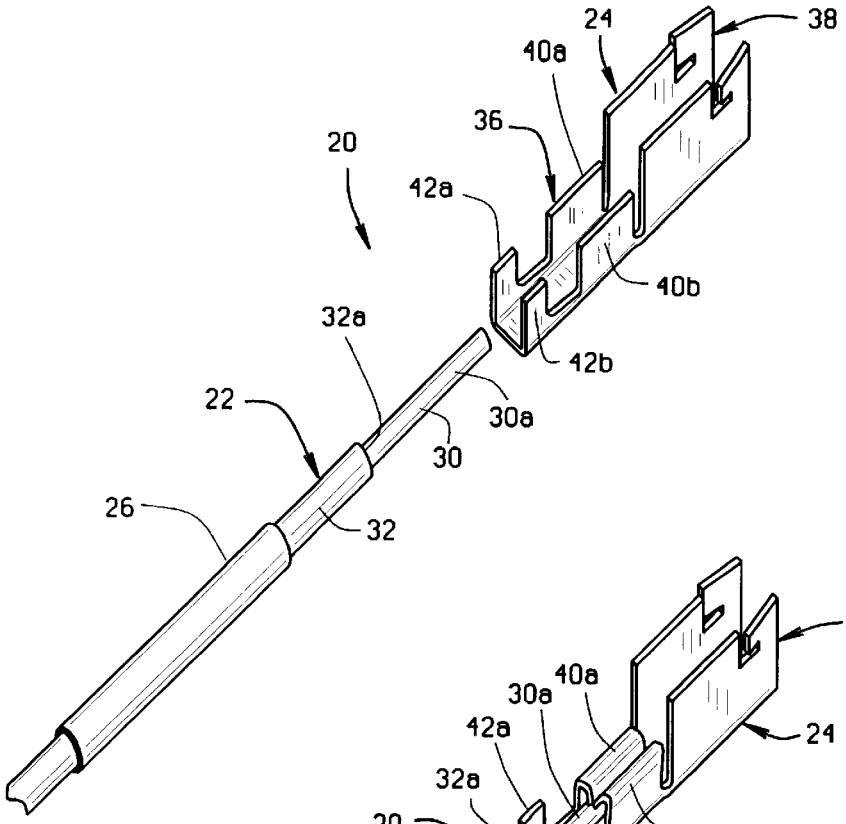
FIG. 1 is a perspective view of an electrical connection of the present invention, the connection having an electric conductor, electrically conductive terminal, and sleeve, the electric conductor having a wire and cladding surrounding the wire with an exposed end portion of the wire extending from an end of the cladding, the conductor and sleeve being spaced from the terminal.
Figure 2:
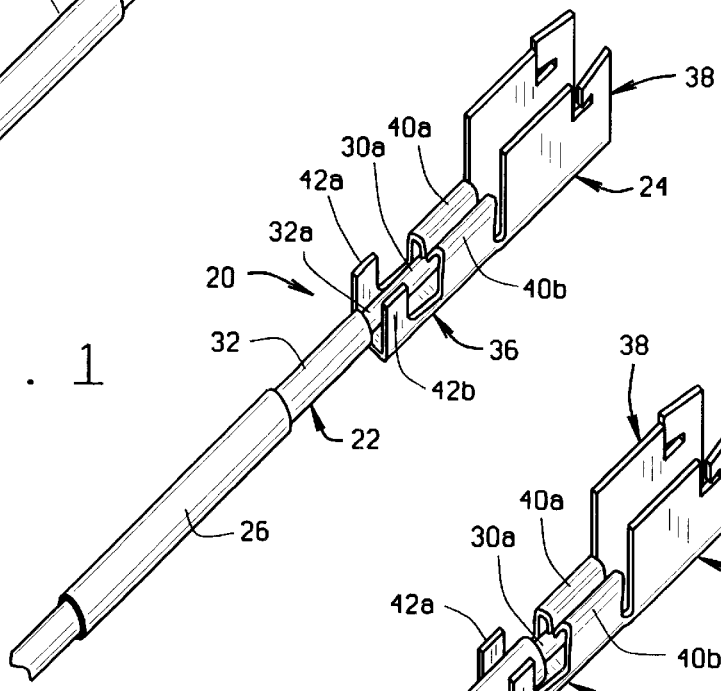
FIG. 2 is a perspective view similar to FIG. 1 but with the wire of the conductor positioned adjacent the terminal and with wire holding tabs of the terminal bent to hold the wire.

The terminal 24 includes a conductor-receiving region, generally indicated at 36, for receiving the conductor 22, and a terminal-receiving region, generally indicated at 38, adapted for connection to a terminal of a device (not shown), such as a house-hold appliance. Preferably, the wire-receiving region 36 comprises an elongate channel sized for receiving a portion of the conductor 22 and a portion of the sleeve 26. The conductor-receiving region 36 comprises a pair of wire-engageable tabs 40*a*, 40*b*, and a pair of insulation-engageable tabs 42*a*, 42*b*. As discussed in greater detail below, the tabs 40*a*, 40*b*, 42*a*, 42*b* are adapted to be crimped in a manner to hold the wire 30 and sleeve 26. As shown in FIGS. 1 and 2, the wire-engageable tabs 40*a*, 40*b* are spaced from one another before being crimped, and the insulation-engageable tabs 42*a*, 42*b* are spaced from one another before being crimped.

The sleeve 26 is of an electrically insulative material surrounding the conductor 22, and is preferably of the same material as the cladding 32. Preferably, the sleeve 26 is sized for sliding along the exterior of the cladding 32. In particular, the inside diameter of the sleeve 26 is preferably slightly larger than the outside diameter of the cladding 32. Also preferably, the sleeve 26 is of a flexible, one-piece construction and completely circumscribes the conductor 22.

Figure 3:
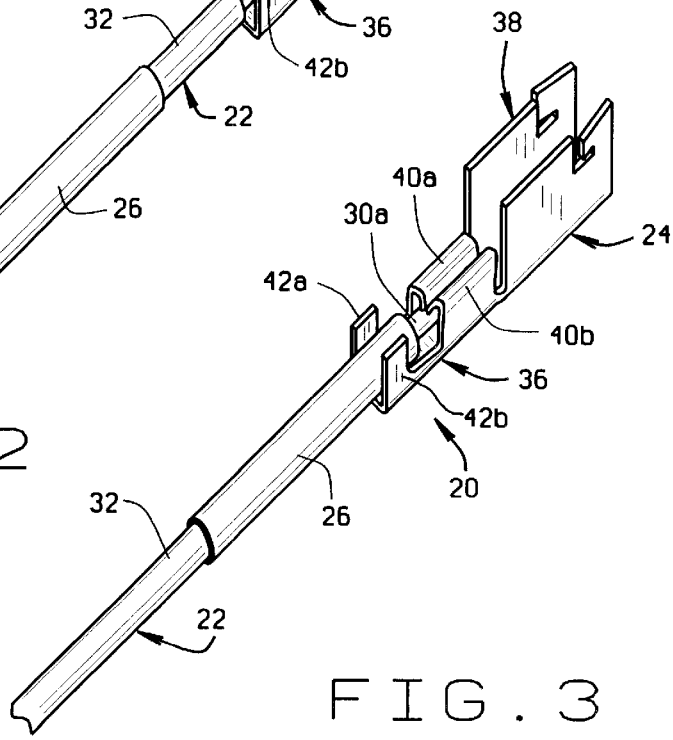
FIG. 3 is a perspective view similar to FIG. 2 but with the sleeve slid into contact with the terminal.

To attach the electric conductor 22 to the terminal 24, the sleeve 26 is placed over the conductor so that the sleeve surrounds an intermediate portion of the conductor and is spaced from the exposed end portion 30*a* of the wire 30 and the end 32*a* of the cladding 32. The exposed end portion 30*a* of the wire 30 is placed in the conductor-receiving region 36 of the terminal 24 adjacent the wire-engageable tabs 40*a*, 40*b*. The wire-engageable tabs 40*a*, 40*b* are then crimped or otherwise bent (see FIG. 2) to secure the exposed end portion 30*a* of the wire 30 to the terminal 24. The tabs 40*a*, 40*b* mechanically secure and electrically couple the exposed end portion 30*a* to the terminal 24. As shown in FIG. 2, the cladding end 32*a* is slightly spaced from the insulation-engageable tabs 42*a*, 42*b*. Thus, crimping of the insulation-engageable tabs 42*a*, 42*b* would not engage the cladding 32. As shown in FIG. 3, the sleeve 26 is slid longitudinally along the conductor 22 to a position in which a portion of the sleeve is adjacent the insulation-engageable tabs 42*a*, 42*b*. The insulation-engageable tabs 42*a*, 42*b* are then crimped or otherwise bent (see FIG. 4) to engage the sleeve 26 in a manner to mechanically secure the sleeve to the terminal 24. The sleeve 26 is sufficiently long so that the sleeve covers the cladding end 32*a* when the sleeve is secured by the insulation-engageable tabs 42*a*, 42*b*. The sleeve 26 also covers a protected portion of the wire 30, i.e., the region of the wire's exposed portion 30*a* which is covered by the sleeve. In this embodiment, the protected portion of the wire 30 is the region of the wire which extends from the insulation-engageable tabs 42*a*, 42*b* to the cladding end 32*a* (not shown in FIG. 4).

Although the steps involved in attaching the conductor 22 and sleeve 26 to the terminal 24 have been described as occurring in a particular order, it is to be understood that the order of the steps is not critical. For example, although the step of crimping the wire-engageable tabs 40*a*, 40*b* preferably occurs before the step of crimping the insulation-engageable tabs 42*a*, 42*b*, it is to be understood that the insulation-engageable tabs could be crimped first without departing from the scope of this invention.

Because of the use of the sleeve 26, the conductor's cladding 32 does not need to be trimmed to a particular length. In other words, the exposed end portion 30*a* of the wire does not need to be a particular length. If the exposed end portion 30*a* is relatively short, then both the sleeve 26 and the cladding end 32*a* will be crimped by the insulation-engageable tabs 42*a*, 42*b*. If the exposed end portion 30*a* is relatively long such that the cladding end 32*a* is spaced from the terminal, then sleeve 26 serves to cover the portion of the wire extending from the tabs 42*a*, 42*b* to the cladding end. Also, because the sleeve 26 preferably has even ends, it does not matter whether the cladding end 32*a* is smooth or uneven.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. An electrical connection comprising:

an electric conductor having a wire and a cladding surrounding the wire, the cladding being of an electrically insulative material, the wire having an exposed end portion extending from an end of the cladding;

an electrically conductive terminal having a first portion and a second portion;

a sleeve surrounding the electric conductor, the sleeve being of an electrically insulative material;

the exposed end portion of the wire being secured to the first portion of the terminal in a manner so that the exposed end portion of the wire is mechanically secured to and electrically coupled to the terminal and so that the second portion of the terminal is generally between the end of the cladding and the first portion of the terminal;

the sleeve being secured to the second portion of the terminal in a manner so that the sleeve is mechanically secured to the terminal, the sleeve covering the end of the cladding and a protected portion of the wire, the protected portion of the wire extending from the first portion of the terminal to the end of the cladding.

2. An electrical connection as set forth in claim 1 wherein the terminal has an elongate channel, at least a portion of the electrical conductor being within the channel and at least a portion of the sleeve being within the channel.

3. An electrical connection as set forth in claim 1 wherein the first portion of the terminal comprises a first tab and wherein the second portion of the terminal comprises a second tab, the first tab being crimped in a manner so that the first tab engages the exposed end portion of the wire, the second tab being crimped in a manner so that the second tab engages the sleeve.

4. An electrical connection as set forth in claim 1 wherein the first portion of the terminal comprises a first pair of tabs and wherein the second portion of the terminal comprises a second pair of tabs, the first pair of tabs being crimped in a manner so that at least one of the tabs of the first pair of tabs engages the exposed end portion of the wire, the second pair of tabs being crimped in a manner so that at least one of the tabs of the second pair of tabs engages the sleeve.

5. An electrical connection as set forth in claim 1 wherein the sleeve completely circumscribes the conductor.

6. An electro-motive device having an electrical connection as set forth in claim 1.

* * * * *